US007135825B2

(12) United States Patent
Tanabe

(10) Patent No.: US 7,135,825 B2
(45) Date of Patent: Nov. 14, 2006

(54) LED POWER SUPPLY DEVICE

(75) Inventor: Tetsuo Tanabe, Aichi-ken (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 0 days.

(21) Appl. No.: 10/926,084

(22) Filed: Aug. 26, 2004

(65) Prior Publication Data

US 2005/0057185 A1 Mar. 17, 2005

(30) Foreign Application Priority Data

Aug. 29, 2003 (JP) ..... 2003-305770

(51) Int. Cl.
*G05F 1/00* (2006.01)

(52) U.S. Cl. ..... 315/308; 315/307; 315/291; 315/209 R

(58) Field of Classification Search ..... 315/291, 315/307, 308, 362; 307/130, 131
See application file for complete search history.

(56) References Cited

U.S. PATENT DOCUMENTS 4,356,433 A * 10/1982 Linden ..... 315/308
6,107,700 A * 8/2000 Ishikawa et al. ..... 307/116
6,320,330 B1 * 11/2001 Haavisto et al. ..... 315/291
6,362,578 B1 * 3/2002 Swanson et al. ..... 315/307
6,400,101 B1 * 6/2002 Biebl et al. ..... 315/291
2002/0014860 A1 * 2/2002 Rachwal ..... 315/291
2003/0169226 A1 * 9/2003 Yamada ..... 345/102
2003/0209997 A1 * 11/2003 St-Germain et al. ..... 315/291
2004/0080301 A1 * 4/2004 Burgyan et al. ..... 323/271
2005/0225515 A1 * 10/2005 Tsuchida et al. ..... 345/76

FOREIGN PATENT DOCUMENTS

JP 2002-98375 4/2002

* cited by examiner

*Primary Examiner*—Hoanganh Le
*Assistant Examiner*—Tung Le
(74) *Attorney, Agent, or Firm*—McGinn IP Law Group, PLLC

(57) ABSTRACT

An LED power supply device has a loop circuit formed by a switching circuit, an LED and a comparison circuit, and a reference voltage generation circuit for providing reference voltage to the comparison circuit. The loop circuit oscillates so that substantially constant current is applied to the LED.

15 Claims, 4 Drawing Sheets

LED POWER SUPPLY DEVICE

The present application is based on Japanese patent application No.2003-305770, the entire contents of which are incorporated herein by reference.

BACKGROUND OF THE INVENTION

1. Field of the Invention

The present invention relates to an LED power supply device. The power supply device of this invention is suitable for in-vehicle use.

2. Description of the Related Art

In an LED power supply device whose conducting current is a few tens of milliamperes, current applied is controlled by connecting a resistor in series with the LED. However, as LED brightness is required to be higher so that the conducting current is a few hundreds of milliamperes, heat released and power consumed by the resistor are innegligible. In addition, since resistor size is larger, and design for heat releasing on a substrate side is required, constraints on design in portions other than the power supply circuit of the LED are caused.

Such resistor constraints can be overcome by using a switching power supply circuit. FIG. 1 shows an example where a versatile switching power supply circuit is applied to an LED.

In this circuit, feedback voltage from the LED is compared with reference voltage from a reference voltage generation circuit 3 at an error amplifier 2. A high-precision circuit of bandgap reference type is typically used for the reference voltage generation circuit 3. A result compared is amplified by a comparator 4, and compared thereat with oscillating voltage of a triangular wave oscillator 5, thereby opening/closing a switching circuit 6. Such versatile switching power supply circuit 7 is typically an integrated circuit.

Japanese patent application laid-open No.2002-98375 discloses such a versatile switching power supply circuit.

The power supply circuit shown in FIG. 1 is versatile, and not specially designed for the LED. It has unnecessary functions for LED lighting control. Although it is equipped with, for example, the independent oscillator 5 so as to continue voltage control operation irrespective of load presence/absence and kind, the oscillator 5 is an unnecessary function in the case where the load is limited to the LED. Although the power supply circuit shown in FIG. 1 uses the high-precision bandgap reference type reference voltage generation circuit 3 with very high temperature dependence to maintain high-precision voltage control, the high-precision bandgap reference type reference voltage generation circuit 3 is also an unnecessary function in the case where the LED is controlled. This is because even if current applied to the LED is changed by about ±20% in a high-brightness region, the human eye cannot recognize its change.

Since the reference voltage of the bandgap reference type reference voltage generation circuit 3 used in many cases is set to more than 1.25V, the feedback voltage from the LED 1 is more than 1.25V. As a result, power consumption due to feedback loss is innegligible.

A switching power supply IC for an LED only has been placed on the market. However, such ICs are costly because they use high-speed switching device for miniaturization, or specialized circuit configuration for high efficiency.

SUMMARY OF THE INVENTION

According to the invention, an LED power supply device comprises:

a loop circuit comprising a switching circuit, an LED and a comparison circuit, and a reference voltage generation circuit for providing reference voltage to the comparison circuit, wherein:

the loop circuit oscillates so that substantially constant current is applied to the LED.

The reference voltage generation circuit may generate the reference voltage by a voltage drop caused by a diode and a resistor.

The reference voltage generation circuit may comprise a first reference voltage generation circuit being operative when the switching circuit is closed, and a second reference voltage generation circuit being operative when the switching circuit is open.

The reference voltage may be 0.1V–0.5V.

According to the power supply device configured in this manner, since the oscillating loop circuit is formed by the essential circuit to operate the LED power supply device comprising the switching circuit, LED and comparison circuit, no independent oscillation circuit such as a triangular wave oscillator is required. Thus, the low-cost device can be realized.

According to another aspect of the invention, the reference voltage generation circuit generates the reference voltage by a voltage drop caused by a diode and a resistor. In comparison with the bandgap reference type reference voltage generation circuit, such a circuit is simple in configuration and its cost can be substantially reduced. According to the simple reference voltage generation circuit of the invention, the precision of the reference voltage obtained cannot be high. As a result, current applied to the LED varies, but the variation of the current cannot be practically detrimental to the LED emitting light with high brightness.

According to the present invention, since the error amplifier of FIG. 1 can be omitted, the low-cost device can be realized.

According to the present invention, by setting the reference voltage to be low compared with the versatile power supply circuit of FIG. 1, feedback voltage from the LED can be low, and power loss can be reduced.

For example, if LED forward voltage is about 3.6V, in the case of the versatile power supply circuit with 1.25V feedback voltage, power loss is 1.25V/(3.6V+1.25V)=0.258, i.e., 25%.

On the other hand, in the power supply circuit of the invention whose reference voltage can be set to any level, when the reference voltage is set to be 0.5V as in the embodiment, power loss is 0.5V/(3.6V+0.5V)=0.122, i.e., about ½ of that of the versatile power supply circuit with 1.25V feedback voltage.

In the power supply circuit of the present invention, the reference voltage can be selected to be any level. If the reference voltage is set to be about 0.05–0.1V, power loss can be further reduced. Taking account of noise effects, etc., the reference voltage is preferably set to about 0.1–0.5V, more preferably 0.3–0.5V.

The switching circuit and the comparison circuit may be versatile. In the embodiment, these are configured by transistors so that cost reduction is ensured.

Although any type of the LED may be used, an LED comprising Group III nitride series compound semiconductors is preferred because of its high-brightness light emission.

Here, Group III nitride series compound semiconductors are represented by general formula $Al_XGa_YIn_{1-X-Y}N$ ($0<X\leqq 1$, $0\leqq Y\leqq 1$, $0\leqq X+Y\leqq 1$). Group III nitride series compound semiconductors containing Al include 2 element series AlN and 3 element series $Al_XGa_{1-X}N$ and $Al_XIn_{1-X}N$ ($0<X\leqq 1$). In Group III nitride series compound semiconductors and GaN, at least a portion of Group III elements may be substituted with boron (B), thallium (Tl), etc., and at least a portion of nitrogen (N) may be substituted with phosphorous (P), arsenic (As), antimony (Sb), bismuth (Bi), etc.

Group III nitride series compound semiconductors may contain any dopant. As n-type impurities, silicon (Si) germanium (Ge), selenium (Se), tellurium (Te), carbon (C), etc., may be used. As p-type impurities, magnesium (Mg), zinc (Zn), beryllium (Be), calcium (Ca), strontium (Sr) Barium (Ba), etc., may be used. After p-type impurity doping, Group III nitride series compound semiconductors may be, but are not essential to be, irradiated with electron rays, plasmas, or exposed to furnace heat.

Layers of Group III nitride series compound semiconductors are formed by MOCVD (Metal Organic Vapor Phase Deposition). Not necessarily all layers constituting the device are formed by the MOCVD, but MBE (Molecular Beam Epitaxy), HVPE (Hydride Vapor Phase Epitaxy), sputtering, ion plating, etc., may be used therewith.

As configuration of the LED, homostructure, heterostructure or double heterostructure having MIS junction, PIN junction or pn junction may be used. As a light-emitting layer, quantum well structure (single quantum well structure or multiple quantum well structure) may be used. As such Group III nitride series compound semiconductor light-emitting devices, there may be used a face-up type whose main light-emitting direction (electrode surface) is an optical-axis direction of the light-emitting device, or a flip-chip type whose main light-emitting direction is opposite to an optical-axis direction to use reflected light.

As a utilization example, the power supply device of the present invention can be used as an LED power supply device for a light source for an interior/exterior decoration and display device of a room, a vehicle, etc.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
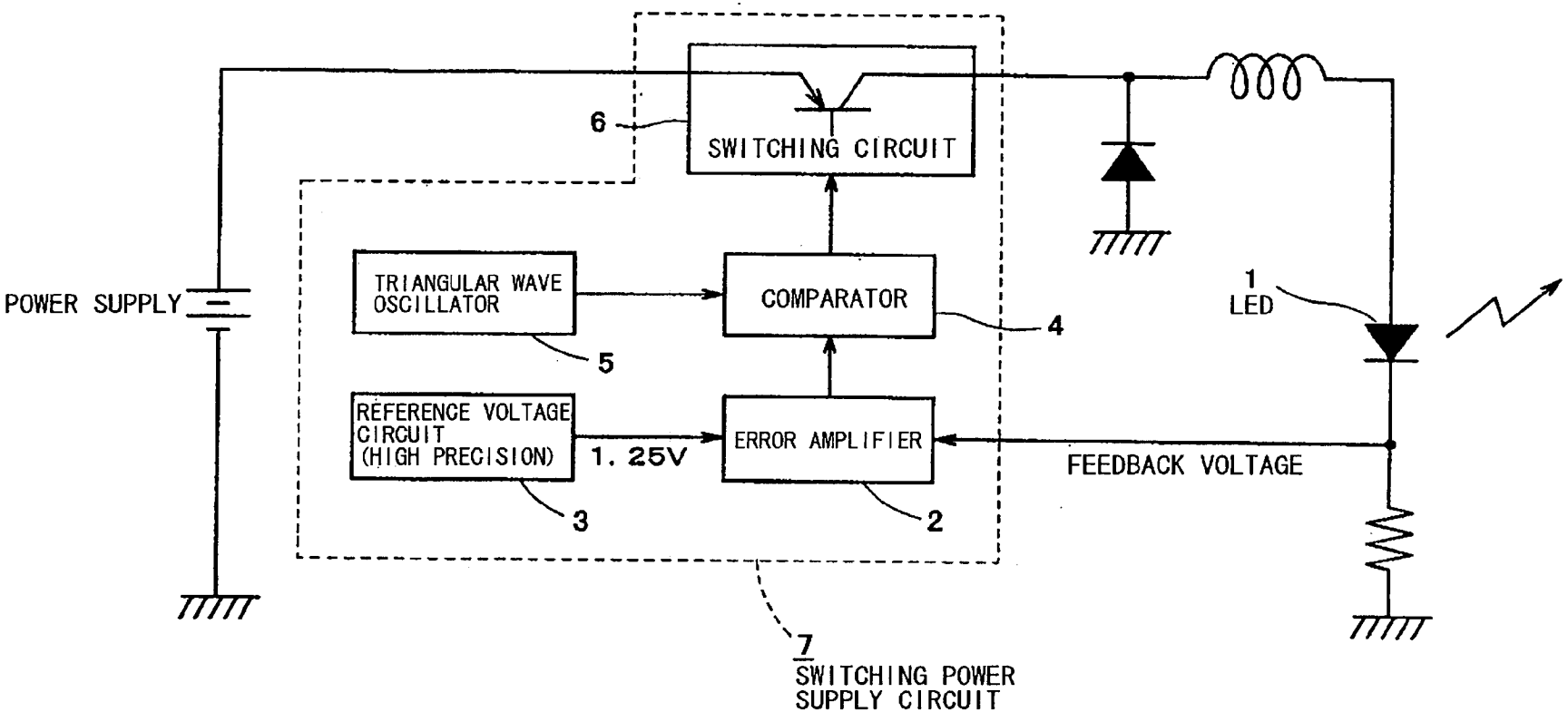
FIG. 1 is a block diagram showing a configuration of a conventional power supply device.
Figure 2:
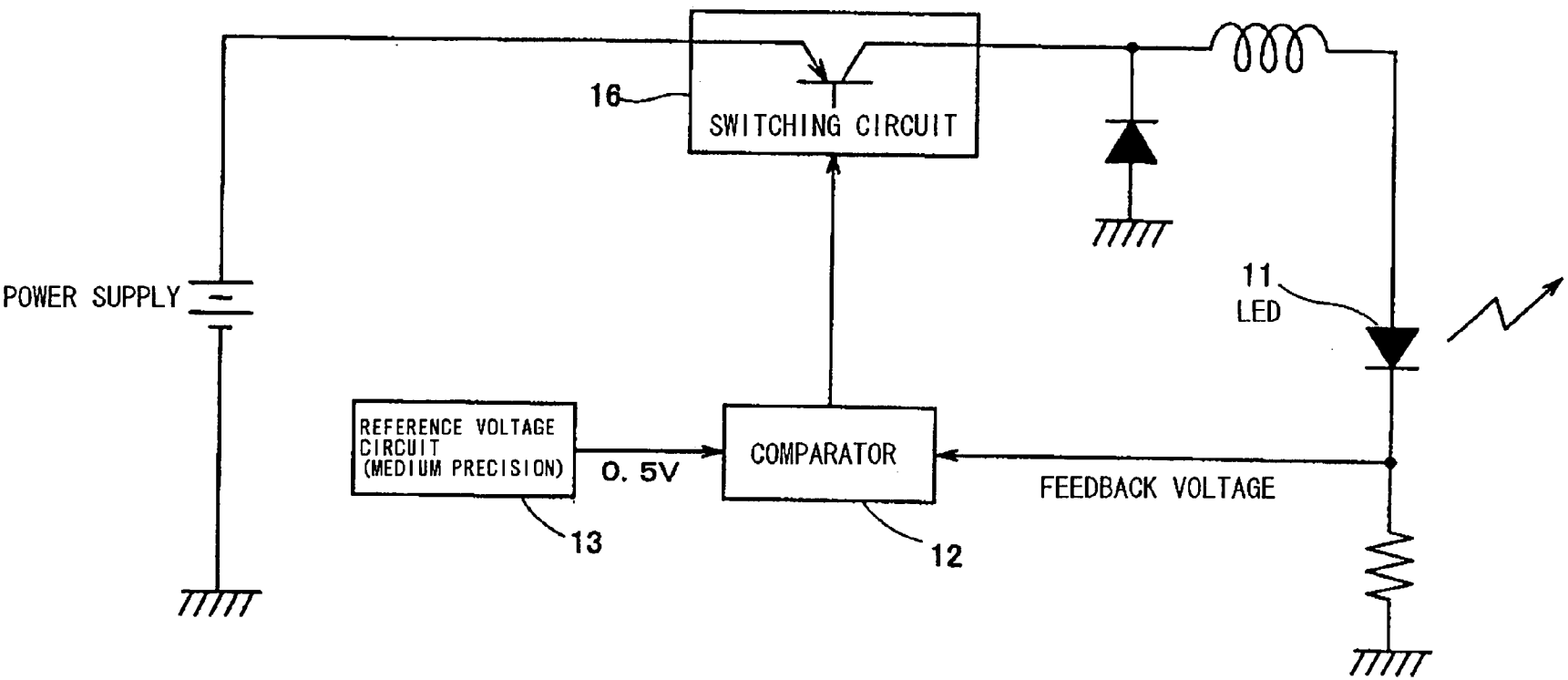
FIG. 2 is a block diagram showing a configuration of a power supply device according to an embodiment of the invention.
Figure 3:
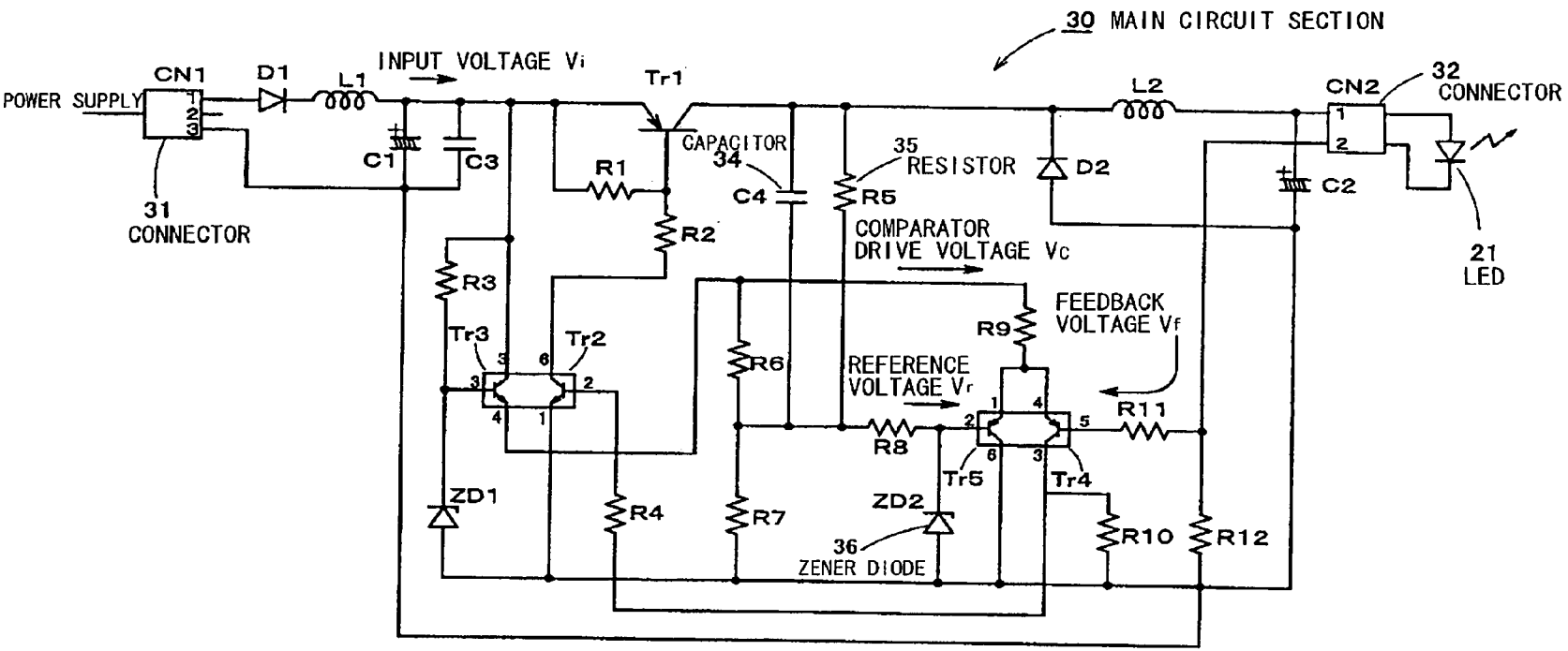
FIG. 3 is a circuit diagram of the power supply device of FIG. 2.

FIG. 2 is a block diagram showing a configuration of a power supply device according to an embodiment of the invention. FIG. 3 is a circuit diagram of the power supply device of FIG. 2.

As apparent from FIG. 2, in the power supply device of the embodiment, feedback voltage from an LED 11 is input to a comparator 12, and compared with reference voltage (about 0.5V) from reference voltage generation circuit 13. A result (control voltage) compared is input to switching circuit 16 to control its turn-on/off. A loop circuit is formed by the switching circuit 16, LED 11 and comparator 12. By turning on/off the switching circuit 16 in response to the control voltage from the comparator 12, the loop circuit oscillates, and current input to the LED 11 is thereby maintained substantially constant.

According to the power supply device of the embodiment configured in this manner, since the oscillating loop circuit is formed by the essential circuit to operate the LED power supply device comprising the switching circuit, LED and comparison circuit, no independent oscillation circuit such as a triangular wave oscillator is required. Thus, the low-cost device can be realized.

Since the reference voltage of 0.5V obtained by the resistance-division of voltage of a Zener diode is used without using bandgap reference, the feedback voltage can be reduced to 0.5V, and power loss due to feedback current can be reduced.

FIG. 3 shows a specific circuit diagram of the power supply device of FIG. 2.

A main circuit section 30 has 2 connectors 31 and 32. The connector 31 is connected to a power supply, and the connector 32 is connected to an LED 21. Input voltage Vi is input to the LED 21 via a transistor Tr1 as a switching circuit, while being also applied to the collector of a transistor Tr3. When the transistor Tr3 is on, the input voltage Vi is comparator drive voltage Vc (about 6V) which is applied to transistors Tr4 and Tr5. This voltage is also applied to the base of the transistor Tr5 as reference voltage Vr (about 0.5V). In other words, the transistor Tr3 serves as a first reference voltage generation circuit.

On the other hand, feedback voltage Vf of the LED 21 is applied to the base of the transistor Tr4. As a result, operation of the transistors Tr4 and Tr5 is as follows:

Tr5 is off and Tr4 is on for reference voltage Vr>feedback voltage Vf.

Tr5 is on and Tr4 is off for reference voltage Vr<feedback voltage Vf.

Thus, when reference voltage Vr>feedback voltage Vf, i.e., when the output of the LED is (or is reduced to) less than the reference value, the transistor Tr4 is turned on, and the potential at the base of transistor Tr2 is high, turning on the transistor Tr2. As a result, the potential at the base of transistor Tr1 is low, turning on the transistor Tr1. This allows power from the power supply to be applied to the LED 21, increasing its output.

Since the transistor Tr5 is then turned off, the transistor Tr3 is turned off and no longer serves as the reference voltage generation circuit. Instead (i.e., during its transient state), with voltage which has passed through the transistor Tr1, the reference voltage Vr is applied to the base of the transistor Tr5 via a capacitor 34 and a resistor 35. A second reference voltage generation circuit is configured by the capacitor 34, resistor 35 and zener diode 36. This makes the Tr5 off-state and Tr4 on-state definitive.

When the transistor Tr1 is turned on and the output of the LED 21 is high, the feedback voltage Vf is high. As a result, when reference voltage Vr<feedback voltage Vf, the transistor Tr4 is turned off (the transistor Tr5 on at the same time), transistor Tr2 off, and transistor Tr1 off, causing the feeding to the LED 21 to stop. Since the transistor Tr1 is turned off, generating reference voltage via the capacitor 34 and the resistor 35 is impossible, returning to the first reference voltage. In this manner the entire circuit oscillates, the transistor Tr5 is turned on and the transistor Tr3 is turned on, thereby restoring the generation of reference voltage in this route. In this manner the entire circuit oscillates, thereby holding substantially constant current applied to the LED 21.

When the transistor Tr1 is turned off, as the voltage applied to the LED 21 is reduced, the power supply device shown in FIG. 3 is of a step-down type.

Figure 4:
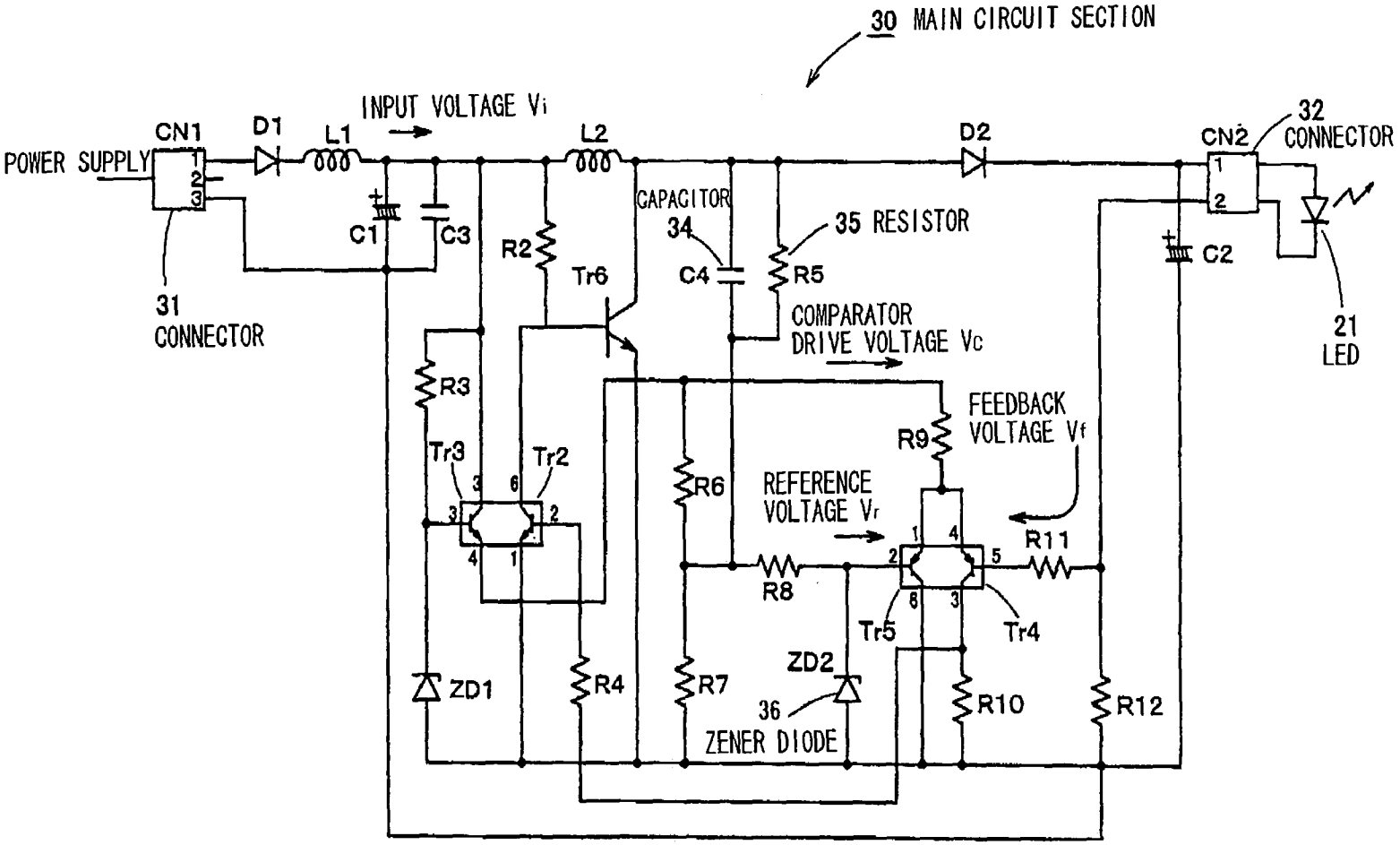
FIG. 4 is another circuit diagram of the power supply device of FIG. 2.

FIG. 4 shows another circuit diagram of the power supply device of FIG. 2. In FIG. 4, same elements as those of FIG. 3 are denoted by same characters, and their explanation is omitted. The differences in configuration between main circuit section 30 of FIG. 3 and main circuit section 40 of FIG. 4 are in position and type of transistors Tr1 and Tr6 constituting a switching circuit.

In FIG. 4, when the output of an LED 21 increases, and reference voltage Vr<feedback voltage Vf, transistor Tr4 is turned off, transistor Tr2 off, and transistor Tr6 on, input voltage Vi escapes to a transistor Tr6 side, causing voltage applied to the LED 21 to be reduced. As a result, when reference voltage Vr>feedback voltage Vf, the transistor Tr4 is turned on (the transistor Tr5 off at the same time), transistor Tr2 on, and transistor Tr6 off, causing energy of coil L2 to be released, and voltage applied to the LED 21 to be increased. In this manner the entire circuit oscillates, thereby holding substantially constant current applied to the LED 21.

When the transistor Tr6 is turned off, as the voltage applied to the LED 21 is increased, the power supply device shown in FIG. 3 is of a step-up type.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An LED power supply device, comprising:

a loop circuit comprising a switching circuit, an LED and a comparison circuit; and a reference voltage generation circuit for providing reference voltage to the comparison circuit, wherein:

the loop circuit oscillates so that substantially constant current is applied to the LED; and the reference voltage generation circuit comprises a first reference voltage generation circuit being operative when the switching circuit is closed, and a second reference voltage generation circuit being operative when the switching circuit is open.

2. The LED power supply device according to claim 1, wherein:

the reference voltage is 0.1V–0.5V.

3. An LED power supply device, comprising:

a loop circuit comprising a switching circuit, an LED and a comparison circuit; and a reference voltage generation circuit for providing reference voltage to the comparison circuit, wherein:

the loop circuit oscillates so that substantially constant current is applied to the LED;

the reference voltage generation circuit generates the reference voltage by a voltage drop caused by a diode and a resistor; and the reference voltage generation circuit comprises a first reference voltage generation circuit being operative when the switching circuit is closed, and a second reference voltage generation circuit being operative when the switching circuit is open.

4. The LED power supply device according to claim 3, wherein:

the reference voltage is 0.1V–0.5V.

5. An LED power supply device, comprising:

a loop circuit comprising a switching circuit, an LED and a comparison circuit; and a reference voltage generation circuit for providing reference voltage to the comparison circuit, wherein:

the loop circuit oscillates so that substantially constant current is applied to the LED;

said reference generation circuit comprises a plurality of reference voltages effectively applied as an input into said comparison circuit, said LED power supply device further comprising:

a voltage feedback from said LED as a second input into said comparison circuit, said comparator causing said oscillation by switching between said plurality of reference voltages.

6. A self-oscillating light emitting diode (LED) power supply circuit, comprising:

a switching circuit that switches a voltage to an LED;

a comparator that controls said switching circuit; and a reference voltage generation circuit that generates a plurality of reference voltages, wherein said comparator establishes a self-oscillatory switching between said plurality of generated reference voltages, based on comparing said generated reference voltages with a feedback voltage from said voltage switched to said LED.

7. The self-oscillating LED power supply circuit of claim 6, said self-oscillatory switching thereby providing a substantially constant current to flow through said LED.

8. The self-oscillating LED power supply circuit according to claim 6, wherein:

the reference voltage generation circuit comprises a first reference voltage generation circuit being operative when the switching circuit is closed, and a second reference voltage generation circuit being operative when the switching circuit is open.

9. The self-oscillating LED power supply circuit according to claim 6, wherein:

the reference voltage generation circuit generates each of said plurality of reference voltages by a voltage drop caused by a diode in combination with a resistor that is respectively part of a different reference voltage generation section.

10. The self-oscillating LED power supply circuit according to claim 6, as fabricated on an electronic chip, said LED power supply device further comprising:

terminals to connect to said LED, said LED being external to said electronic chip; and terminals to connect to a power source external to said electronic chip.

11. The self-oscillating LED power supply circuit according to claim 9, wherein:

the reference voltage is 0.1V–0.5V.

12. A self-oscillating light emitting diode (LED) power supply circuit, comprising:

a switching circuit that switches a voltage to an LED;

a comparator that controls said switching circuit; and a reference voltage generation circuit that generates a plurality of reference voltages, wherein said comparator establishes a self-oscillatory switching between said plurality of generated reference voltages to provide a substantially constant current through said LED.

13. The self-oscillating LED power supply circuit according to claim 12, wherein:

said self-oscillatory switching is based on comparing said generated reference voltages with a feedback voltage from said voltage switched to said LED.

14. The self-oscillating LED power supply circuit according to claim 12, wherein:

the reference voltage generation circuit comprises a first reference voltage generation circuit being operative when the switching circuit is closed, and a second reference voltage generation circuit being operative when the switching circuit is open.

15. The self-oscillating LED power supply circuit according to claim 12, wherein:

the reference voltage generation circuit generates each of said plurality of reference voltages by a voltage drop caused by a diode in combination with a resistor that is respectively part of a different reference voltage generation section.

* * * * *